US008692472B2

(12) United States Patent
Fujimoto

(10) Patent No.: US 8,692,472 B2
(45) Date of Patent: Apr. 8, 2014

(54) LED DRIVING METHOD AND DRIVING POWER SOURCE DEVICE

(75) Inventor: Toyotsugu Fujimoto, Saitama (JP)

(73) Assignees: Hayterzlab, Soka-Shi, Saitama (JP); Heiwa, Kawaguchi-Shi, Saitama (JP)

( * ) Notice: Subject to any disclaimer, the term of this patent is extended or adjusted under 35 U.S.C. 154(b) by 95 days.

(21) Appl. No.: 13/525,732

(22) Filed: Jun. 18, 2012

(65) Prior Publication Data

US 2013/0257299 A1 Oct. 3, 2013

(30) Foreign Application Priority Data

Mar. 30, 2012 (JP) ..... 2012-081578

(51) Int. Cl.
*H05B 37/00* (2006.01)

(52) U.S. Cl.
USPC ..... 315/186; 315/185 R

(58) Field of Classification Search
None
See application file for complete search history.

(56) References Cited

U.S. PATENT DOCUMENTS

| | | | | |
|---|---|---|---|---|
| 7,482,760 | B2 * | 1/2009 | Jungwirth et al. | 315/185 R |
| 8,049,428 | B2 * | 11/2011 | Yang | 315/205 |
| 8,063,571 | B2 * | 11/2011 | Yang | 315/224 |
| 8,093,821 | B2 * | 1/2012 | Loo et al. | 315/209 R |
| 8,294,375 | B2 * | 10/2012 | Lee | 315/186 |
| 2012/0223649 | A1 * | 9/2012 | Saes et al. | 315/186 |

FOREIGN PATENT DOCUMENTS

| | | |
|---|---|---|
| JP | 2006-058909 | 3/2006 |
| JP | 2010-040659 | 2/2010 |
| JP | 2012-054351 | 3/2012 |

* cited by examiner

*Primary Examiner* — Crystal L Hammond
(74) *Attorney, Agent, or Firm* — Jacobson Holman PLLC

(57) ABSTRACT

Each of blocks includes an arbitrary number of series connections of LEDs. A current signal for controlling operation of the LEDs in the blocks is divided into plural signal currents. An allowable forward current having a duty cycle corresponding to a division number is caused to flow through the LEDs in one block for an allowable time, using one of the signal currents. A rated forward current that does not cause destruction of LEDs is caused to flow through the LEDs in the other blocks, using the other of the signal currents. The LEDs in the blocks are driven by causing the allowable forward current and the rated forward current to flow periodically. The rated forward current is caused to flow through at least one additional LED, whereby a difference between respective voltages corresponding to the allowable forward current and the rated forward current is produced.

5 Claims, 11 Drawing Sheets

LED DRIVING METHOD AND DRIVING POWER SOURCE DEVICE

BACKGROUND OF THE INVENTION

1. Field of the Invention

The present invention relates to an LED driving method and driving power source device for enhancement of the luminous intensity of LEDs.

2. Description of the Related Art

The LED is a device in which its luminous intensity, efficiency, life, etc. are optimized at a rated current. Where a current that is smaller than the rated current flows through the LED, its luminous intensity is low though its life and efficiency are increased. Conversely, where a current that is larger than the rated current flows through the LED, although the luminous intensity is high, the efficiency lowers to generate more heat and the life is shortened because it is easily affected by heat. The LED may be broken if an unduly large current is caused to flow through it to increase the luminous intensity; it should be avoided to cause a current that is lager than the rated current to flow through the LED.

Therefore, conventionally, because of the above properties of the LED, constant current circuits are mainly used as LED driving power source devices. The only method for increasing the luminous intensity of an LED light source is to increase the arrangement density of LEDs.

Reference 1, JP-A-2006-58909 discloses a technique for improving the display quality of an electrooptic device. However, this technique is directed to an electrooptic device which uses an electrooptic element whose luminous intensity is proportional to the drive current. Since the luminous intensity of the LED is not proportional to the drive current, it is difficult to increase the luminous intensity of the LED by using this technique.

The inventor of this application worked on the development of techniques for the luminous intensity enhancement of LEDs and filed the Japanese application corresponding to Patent Reference 2, JP-A-2010-40659 on the basis of results of that project. The technique of Patent Reference 2 employs series connections of many LEDs. However, the voltage consumed by the LED increases as the current flowing through it is increased. Therefore, if different currents flow through a series connection of LEDs, a larger difference occurs between the voltages developing across the series connection of LEDs as the number of LEDs is increased. As a result, if a voltage is set for a large reference current, a large amount of power is consumed uselessly by current limiting resistors etc. when the current is small and, in addition, the power consumed by the current limiting resistors etc. raises a problem of heat generation. As such, the technique of Patent Reference 2 which employs series connections of LEDs has a problem of a large power loss; it is expected that a product based on this technique will not be very useful.

In view of the above, the inventor continued the development of necessary means and devices to solve the problem of useless consumption of power on the basis of a technique of increasing the luminous intensity by changing the drive interval in a pulsed driving method and filed an application corresponding to Patent Reference 3, JP-A-2012-05431. This technique can solve the above-described problem almost completely. More specifically, when series connections of many LEDs are used, the problem of a voltage difference between a series connection of LEDs through which a rated forward current flows and a series connection of LEDs through which an allowable forward current flows is solved (the useless power consumption is minimized) by preparing two voltage sources having high efficiency in advance and switching between those two voltage sources. However, because of the use of the two voltage sources, this technique raises other problems, that is, the cost and the volume occupied are increased.

Patent Reference 1: JP-A-2006-058909

Patent Reference 2: JP-A-2010-040659

Patent Reference 3: JP-A-2012-054351

In the above circumstances, the present inventor conceived the present invention by continuing the development to enhance the luminous intensity enhancement of LEDs, that is, making a study diligently to solve the problem of useless consumption of power on the basis of the technique of increasing the luminous intensity by changing the drive interval in the pulsed driving method (the same technique as in Patent Reference 3).

SUMMARY OF THE INVENTION

A principal object of the present invention is to provide an LED driving method and driving power source device which can increase the luminous intensity without damaging LEDs and does not cause useless consumption of power by current limiting resistors etc.

Another object of the invention is to solve the problem that a voltage difference occurs between series connections of LEDs through which rated forward currents flow and series connections of LEDs through which allowable forward currents flow when series connections of many LEDs are used, without causing such a disadvantage as use of two voltage sources.

Another object of the invention is to provide an LED driving method and driving power source device which can increase the luminous intensity efficiently at a lower cost by minimizing the useless power consumption and the cost by causing light emission of an LED (s) utilizing the above voltage difference.

To attain the above objects, the invention provides an LED driving method including the steps of providing one or more blocks each of which includes an arbitrary number of series connections of LEDs; dividing a current signal for controlling operation of the LEDs in the blocks into plural signal currents; causing an allowable forward current having a duty cycle corresponding to a division number of the dividing step to flow through the LEDs in one of the blocks for an allowable time, using one of the plural signal currents; causing a rated forward current that does not cause destruction of LEDs to flow through the LEDs in the other blocks, using the other of the plural signal currents; driving the LEDs in the blocks by causing the allowable forward current and the rated forward current to flow periodically; and causing the rated forward current to flow through at least one additional LED and thereby producing a difference between respective voltages corresponding to the allowable forward current and the rated forward current.

The term "rated forward current" used above means a forward current that does not cause destruction of an LED.

The term "allowable forward current" means a forward current having a duty ratio which is the ratio of an on time to the period of a current flowing through each LED.

The term "a series connection(s) of LEDs" means an arbitrary number of series connections of LEDs.

The term "one block" is a generic term of one or more series connections of LEDs.

The invention also provides an LED driving power source device including pulse current generating means for generating pulse currents as a current signal for controlling operation of series connections of LEDs; signal current allocating means for generating signal currents by switching the current signal generated by the pulse current generating means in units of a period of the current signal; first switching circuits each of which is turned on only during periods when a signal current produced by the signal current allocating means flows and thereby causes an allowable forward current having a duty cycle corresponding to an allocation number of the signal current allocating means to flow through one of the series connections of LEDs; second switching circuits each of which is turned on only during periods when no signal current produced by the signal current allocating means flows and thereby causes a rated forward current that does not cause destruction of LEDs to flow through the other of the series connections of LEDs; and at least one additional LED for producing a difference between respective voltages corresponding to the allowable forward current and the rated forward current as a result of flow of the rated forward current through the LED, the series connections of LEDs being driven by causing the allowable forward current and the rated forward current to flow periodically for an allowable time determined by the switching of the signal current allocating means.

In the above LED driving power source device, the pulse current generating means generates a pulse current signal having an arbitrary frequency. In the invention, the pulse current generating means may employ various means and have various configurations which will be described later. The signal current allocating means generates signal currents by switching the current signal generated by the pulse current generating means in units of a period of the current signal.

In the above LED driving power source device, when a current signal is present, a value of the pulse is high, and when a current signal is absent, a value of the pulse is low.

The above LED driving power source device is provided with the first switching circuits each of which is turned on only during periods when a current signal produced by the signal current allocating means flows and thereby causes an allowable forward current having a duty cycle corresponding to an allocation number of the signal current allocating means to flow through one of the series connections of LEDs, and the second switching circuits each of which is turned on only during periods when no current signal produced by the signal current allocating means flows and thereby causes a rated forward current to flow through the other of the series connections of LEDs.

In order to produce a voltage corresponding to a difference between forward voltages that develop across each series connection of LEDs so as to correspond to an allowable forward current and a rated forward current, respectively, the above LED driving power source device is provided with the additional LED (s) in such a manner that it is connected to the series connection (s) of LEDs through which a rated current (s) is flowing.

In the above LED driving power source device, the series connections of LEDs are driven by causing the allowable forward current and the rated forward current to flow periodically for an allowable time. Therefore, the increase of the load on each LED can be made negligible, and the luminous intensity can be increased with almost no reduction in efficiency even if the LEDs used are completely the same as used conventionally.

The pulse current generating means may be a clock generation circuit for generating the current signal, and the signal current allocating means may include an allocation circuit for generating signals including the respective signal currents and an inversion circuit for inverting the signals generated by the allocation circuit. For example, the pulse current generating means may be a clock generation circuit for generating the current signal, and the signal current allocating means may include a clock signal allocation circuit for successively outputting clock signals which are on during respective cycles of the clock signal generated by the clock generation circuit and an inversion circuit for inverting the clock signals generated by the clock signal allocation circuit to generate clock signals to be supplied to the second switching circuits. This configuration makes it possible to increase the luminous intensity under arbitrary and proper conditions using currently available LEDs.

Alternatively, the signal current allocating means may include a clock generation circuit for generating the clock signal, and a clock signal inversion circuit for dividing each one-cycle portion of the clock signal generated by the clock generation circuit into two parts and outputs a resulting one-cycle portion with a time shift that is half of the one-cycle time. This configuration can attain the objects using more simplified signal current allocating means.

As a further alternative, a clock signal generated by a clock generation circuit may directly be supplied to an electronic switch. In this case, there exists only one series connection of LEDs. This LED power source device which is a simplest implementation form of the invention can also attain the objects.

The pulse current generating means includes an AC power source and signal generating means for generating a signal by detecting cycles of an output voltage of the AC power source (controlling electronic switches according to cycles of an external AC voltage). In this case, the pulse current generating means includes an AC power source and signal generating means for controlling electronic switches by half-wave-rectifying an output current signal of the AC power source and using a half-wave-rectified current signal. More specifically, transistors (switching elements) are controlled directly by signal currents produced by half-wave-rectifying the AC current signal. This is an example capable of simplifying the pulse current generating means.

The invention is configured and works in the above-described manner, whereby an allowable forward current and a rated forward current are caused to flow periodically for an allowable time determined by the switching of the signal current allocating means. The invention thus provides an advantage that the luminous intensity can be increased safely and reliably without damaging LEDs or causing useless consumption of power by current limiting resistors etc. which are used for eliminating a difference between forward voltages corresponding to a rated forward current and an allowable forward current, respectively. The invention can solve the problem that a voltage difference occurs between a series connection of LEDs through which a rated forward current flows and a series connection of LEDs through which an allowable forward current flows when series connections of many LEDs are used, without causing such a disadvantage as use of two voltage sources. Furthermore, the invention can provide an LED driving method and driving power source device which can increase the luminous intensity efficiently at a lower cost by minimizing the useless power consumption and the cost by causing light emission of an LED (s) utilizing the above voltage difference.

DETAILED DESCRIPTION OF THE INVENTION

LED driving power source devices according to embodiments of the present invention will be hereinafter described in detail with reference to the drawings.

Figure 1:
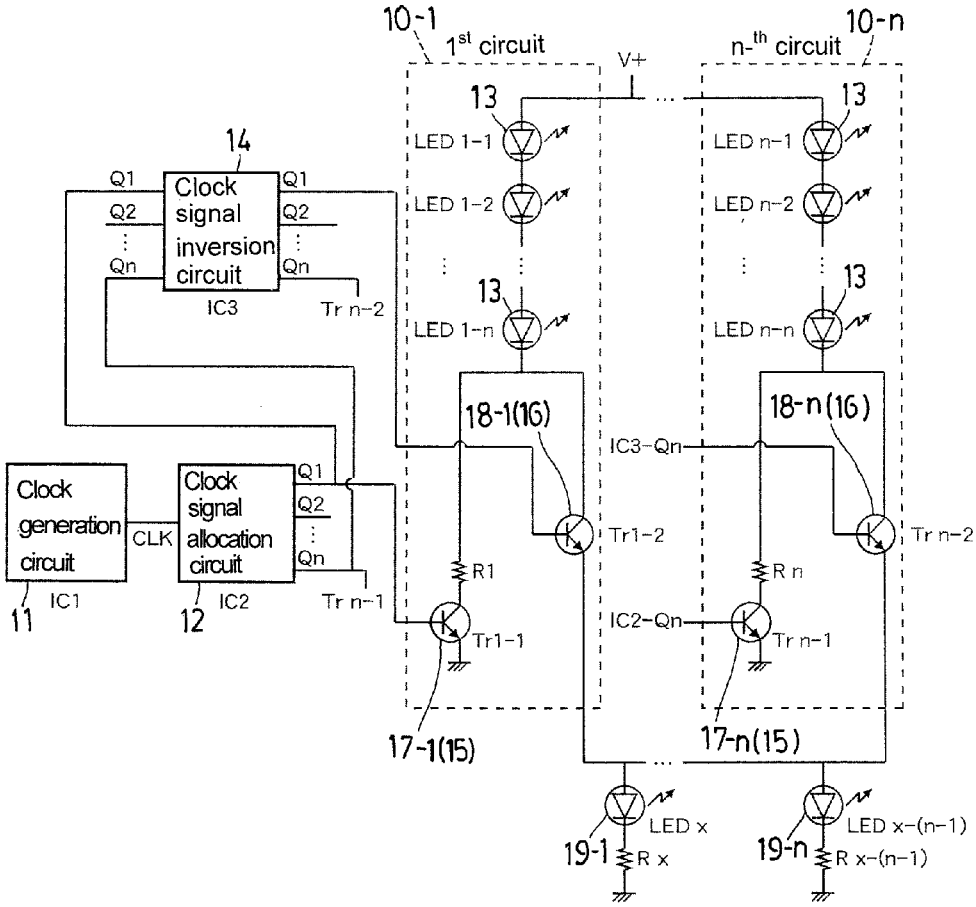
FIG. 1 is a block diagram of an LED driving power source device according to a first embodiment of the present invention.

FIG. 1 conceptually shows an LED driving power source device according to a first embodiment. The power source device is equipped with a clock generation circuit 11 (pulse current generating means) which generates pulse currents as a current signal. The clock generation circuit 11 generates a clock signal CLK1, which is divided into n parts (n: integer) by a clock signal allocation circuit 12 (signal current allocating means). That is, one-cycle portions of the clock signal CLK1 are output successively as parts of signals Q1, Q2, . . . , Qn, respectively. In the clock signal CLK1, each cycle consists of a top voltage and a bottom voltage (see a signal IC1CLK shown in FIG. 2). In the first embodiment, in each signal Q that is output from the clock signal allocation circuit 12, a top voltage lasts over the entire one-cycle period of the clock signal CLK1 (see a signal IC2Q1 shown in FIG. 2).

Figure 2:
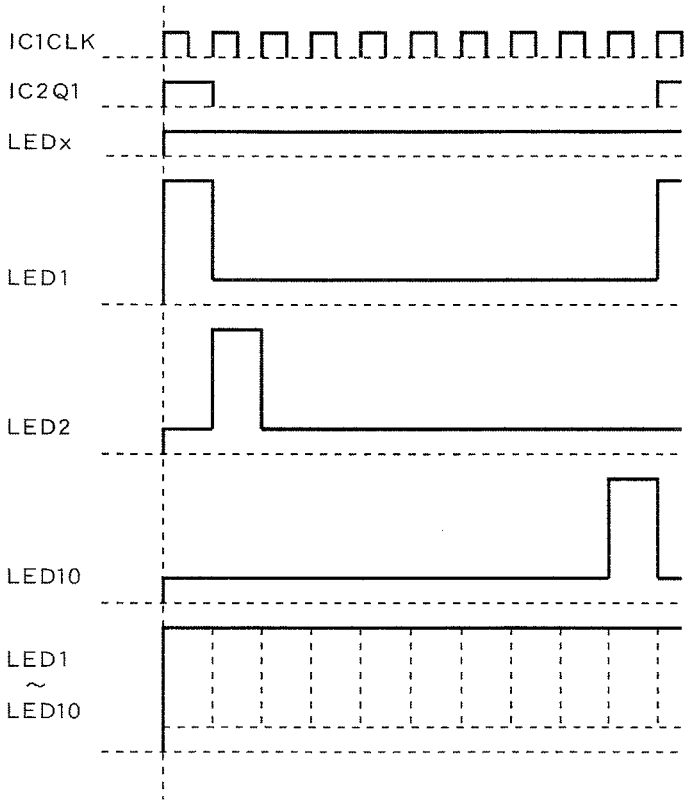
FIG. 2 is a timing chart showing how the LED driving power source device of FIG. 1 operates.
Figure 7:
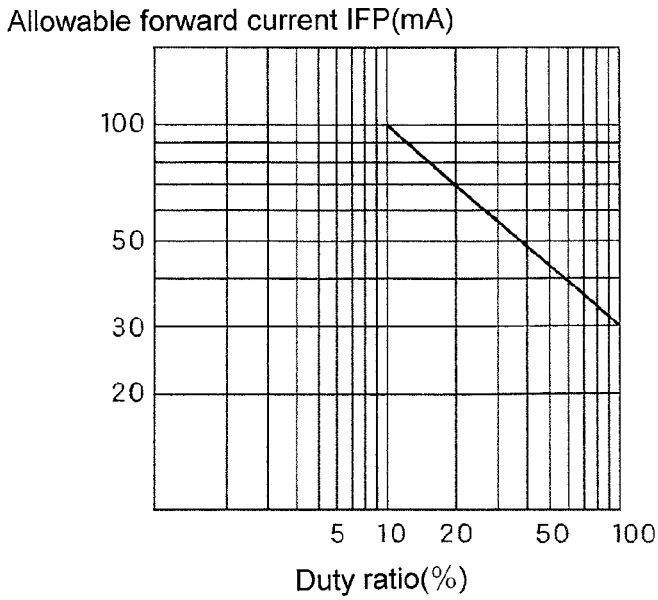
FIG. 7 is a graph showing a relationship between the ratio of the energization time to the unit time (duty ratio) and the allowable forward current of LEDs used in the invention.
Figure 8:
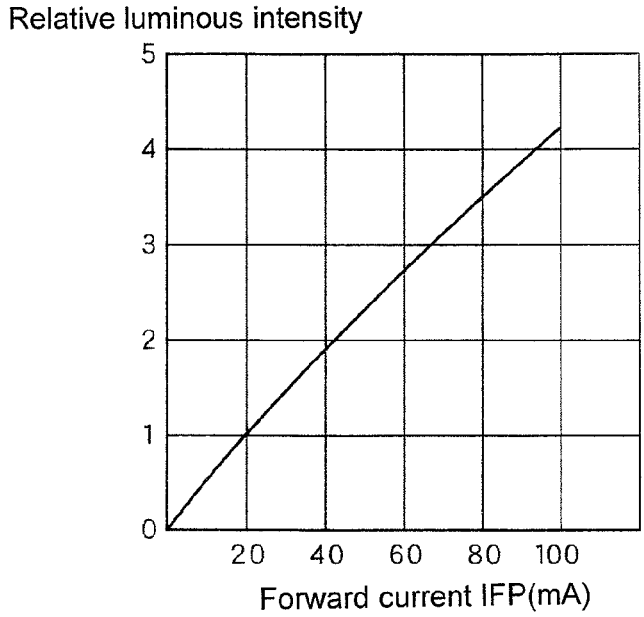
FIG. 8 is a graph showing a relationship between the allowable forward current and the relative luminous intensity of the LEDs used in the invention.

The allocation number n of the clock signal CLK1 is an arbitrary integer that is larger than or equal to 1. FIG. 2 is a timing chart of a case that the allocation number n of the clock signal CLK1 in FIG. 1 is equal to 10. FIG. 7 shows an example relationship between the ratio of the energization time to the unit time (duty ratio) and the allowable forward current. The reason why the signal current allocation number n which is equal to the number of ports shown in FIG. 1 is set at 10 in FIG. 2 is that in many types of LEDs a longest time during which a maximum current can flow through LEDs without causing their destruction is 1/10 of a unit time of 1 second. Therefore, even if the time during which a maximum current flows through LEDs is merely set shorter than 1/10 second, almost no change occurs in the flowable maximum current though the number of LEDs and associated components is increased; the necessity of to employ this option is low. On the other hand, it is possible to set the allocation number n of the clock signal CLK1 to an arbitrary number that is smaller than 10 taking properties of LEDs 13 used. This is meaningful because this method of use conforms to the properties of the LEDs 13.

The LED driving power source device has n output signal lines which are connected to a clock signal inversion circuit 14 for outputting inverted clock signals and elements 15 for controlling the operation of causing an allowable forward current having a duty ratio corresponding to the allocation number n to flow through each series connection of LEDs 13. The n output signal lines are also connected, via the clock signal inversion circuit 14, to elements 16 for controlling the operation of causing a rated forward current that does not cause destruction of LEDs 13 to flow through each series connection of LEDs 13. In the example of FIG. 1, the switching elements 15 for causing flow of allowable forward currents are transistors Tr1-1 to Trn-1 as electronic switches 17-1 to 17-n. The output signal lines of the clock signal allocation circuit 12 are connected to the bases of the transistors Tr1-1 to Trn-1, respectively, and the cathodes of the nearest LEDs of the series connections of LEDs 13 are connected to the collectors of the transistors Tr1-1 to Trn-1, respectively. The emitters of the transistors Tr1-1 to Trn-1 are grounded.

The switching elements 16 for causing rated forward currents to flow through the series connections of LEDS 13 are transistors Tr1-2 to Trn-2 as electronic switches 18-1 to 18-n. At the switching elements 16, output signal lines of the clock signal inversion circuit 14 are connected to the bases of the transistors Tr1-2 to Trn-2, respectively, and the cathodes of the nearest LEDs of the series connections of LEDs 13 are connected to the collectors of the transistors Tr1-2 to Trn-2, respectively. LEDs 19-1 to 19-n for producing forward voltage differences are connected to the emitters of the transistors Tr1-2 to Trn-2, respectively. As shown in FIG. 1, each block includes a series connection of one or more LEDs 13 and is expressed like a first circuit 10-1, for example.

The power source device according to this embodiment is configured in such a manner that an integrated circuit IC1 (555) is used as the clock signal generation circuit 11, an integrated circuit IC2 (74HC4017) is used as the clock signal allocation circuit 12, and an integrated circuit IC3 (74HCU04) is used as the clock signal inversion circuit 14. This is just an example, and it goes without saying that circuits (integrated circuits or non-integrated circuits consisting of discrete elements) that are equivalent to the ICs IC1-IC3 may be used. Resistors for fine current/voltage adjustment are incorporated in each circuit as necessary.

How the voltage source device according to the first embodiment operates will be described below. The voltage source device according to the first embodiment is equipped with the first circuit 10-1 to the nth circuit 10-n each of which has the above-described switching means which is turned on only during periods when a signal current allocated by the clock signal allocation circuit 12 flows and causes an allowable forward current having a duty ratio corresponding to the allocation number n to flow through the associated series connection of LEDs 13 and the above-described switching means which is turned on only during periods when no signal current allocated by the clock signal allocation circuit 12 flows and causes a rated forward current that does not cause destruction of LEDs 13 to flow through the associated series connection of LEDs 13. Therefore, each series connection of LEDs 13 can be driven by causing an allowable forward current having the above duty ratio and a rated forward current to flow through it periodically for an allowable time determined by the switching.

The LEDs 19-1 to 19-n which emit light when rated forward currents flow are connected to the cathodes of the nearest LEDs 13 of the series connections of LEDs 13, respectively. As shown in FIG. 2, the series connection of LEDs LED1 emit light being energized by a first signal current that is allocated by the signal current allocating means. The series connection of LEDs LED2 emit light being energized by the next signal current. In this manner, the series connections of LEDs LED1-LED10 emit light successively. Therefore, since it appears as if each of the series connections of LEDs LED1-LED10 emitted light being energized by an allowable forward current having the above duty ratio, luminance intensity enhancement can be expected without destruction of LEDs 13. In addition, since the LEDs 19-1 to 19-n consume, through light emission, a difference between a forward voltage that occurs when an allowable forward current flows and a forward voltage that occurs when a rated forward current flows, no power is consumed uselessly by current limiting resistors etc.

Figure 3:
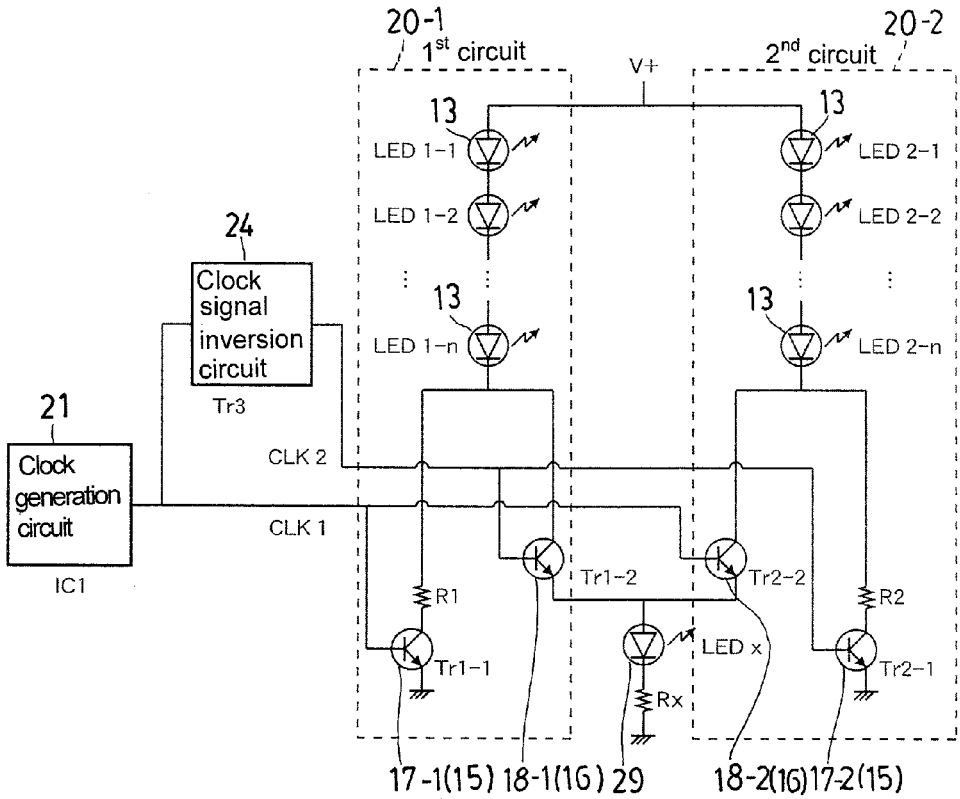
FIG. 3 is a block diagram of an LED driving power source device according to a second embodiment of the invention.

Next, an LED driving power source device according to a second embodiment of the invention will be described with reference to FIG. 3. The power source device according to the second embodiment is of a case that the signal current allocation number n is equal to 2. The power source device is equipped with a clock generation circuit 21 (pulse current generating means) which generates pulse currents as a current signal. A clock signal inversion circuit 24 divides each one-cycle portion of a clock signal CLK1 generated by the clock generation circuit 21 into two parts and outputs a resulting one-cycle portion with a time shift that is half of the one-cycle time. In the second embodiment, since a signal current allocating means is composed of the clock generation circuit 21 and the clock signal inversion circuit 24, the clock signal allocation circuit 12 used in the first embodiment is not necessary.

In the second embodiment, the clock signal CLK1 is divided into two parts. Each of a first circuit 20-1 and a second circuit 20-2 has a transistor switching element 15 as an electronic switch 17-1 or 17-2 for causing an allowable forward current having a duty ratio corresponding to the allocation number and a transistor switching element 16 as an electronic switch 18-1 or 18-n for causing flow of a rated forward current. Two divisional clock signals are supplied to the bases of the switching elements 15 and 16, respectively. The configuration relating to the switching elements 15 and 16 etc. is similar to the corresponding configuration of the first embodiment and hence will not be described in detail (the same references will be used).

In the second embodiment, currents supplied from a voltage source V+ is consumed by the series connections of LEDs 13 provided in the first circuit 20-1 and the second circuit 20-2. The switching elements 15 and 16 are connected to each series connection of LEDs 13. Resistors R1 and R2 for fine current adjustment are connected to the collectors of the switching elements 15 as necessary, respectively, and their emitters are grounded. Allowable forward currents flow through the switching elements 15. Each rated forward current flows to the ground via the switching element 16, the LED 29 (LEDx) for generation of a forward voltage difference, and a resistor Rx for fine current adjustment.

As described above, in the power source device according to the second embodiment, the signal current allocating means includes the clock signal inversion circuit 24 which divides each one-cycle pulse current of a clock signal CLK1 generated by the clock generation circuit 21 into two parts and outputs resulting pulse currents with a time shift that is half of the one-cycle time. Therefore, even without the clock signal allocation circuit 12 used in the first embodiment, the switching between pulse currents (signal currents) generated by the pulse current generating means can be controlled. As a result, each series connection of LEDs 13 can be driven by causing an allowable forward current having the above duty ratio and a rated forward current to flow through it periodically (alternately) for an allowable time determined by the switching.

It should be said that the first embodiment and the second embodiment are basic embodiments of the invention and can be modified in various manners. Various embodiments as modifications of the first and second embodiments will be described below with reference to FIGS. 4-14.

Like the second embodiment, a third embodiment is of a case that the signal current allocation number n is equal to 2. The power source device is equipped with a clock generation circuit 31 (pulse current generating means) which generates pulse currents as a current signal. A clock signal inversion circuit 34 divides each one-cycle pulse current of a clock signal CLK1 generated by the clock generation circuit 31 into two parts and outputs resulting pulse currents with a time shift that is half of the one-cycle time. The third embodiment is different from the second embodiment in that the switching transistors 18-1 and 18-2 (Tr1-2 and Tr2-2) which are used in the second embodiment as the switching elements 16 for causing flow of rated forward currents are replaced by diodes 38-1 and 38-2 (D1 and D2).

Figure 4:
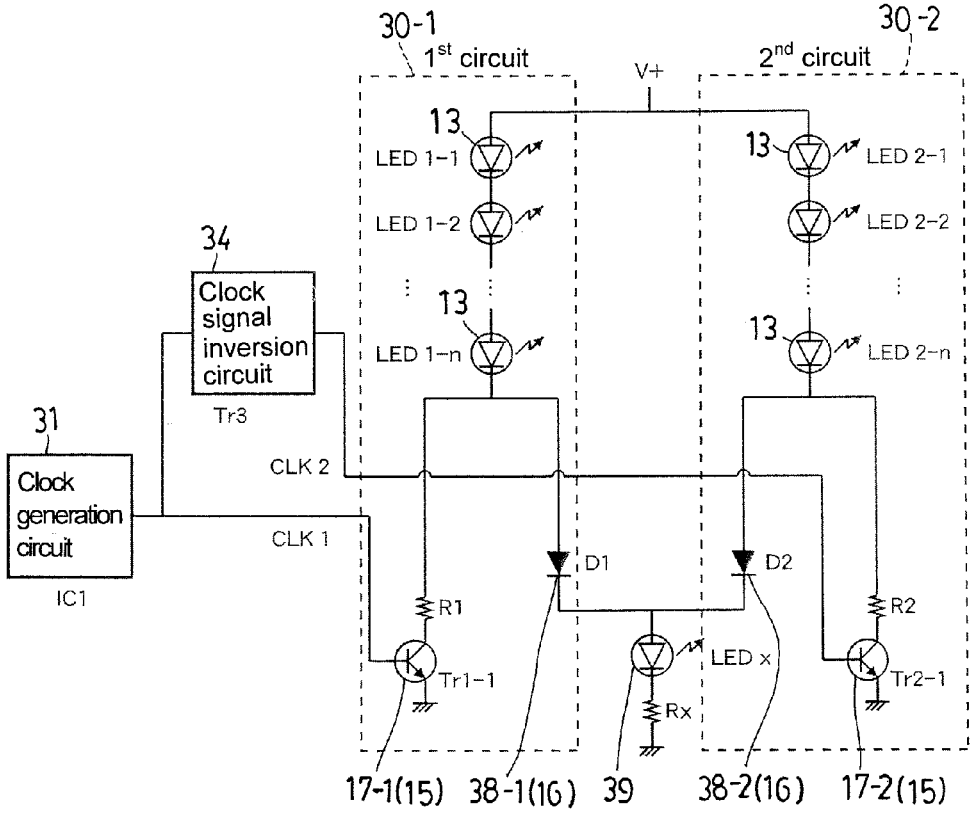
FIG. 4 is a block diagram of an LED driving power source device according to a third embodiment of the invention in which electronic switches used in the second embodiment are replaced by diodes.

Although the circuit of FIG. 4 appears as if to supply a rated current all the time, it is not true. In the first circuit 30-1, when the switching element 15 (Tr1-1) is on, no current flows via the diode 38-1 (D1) from the series connection of LEDs 13 because the voltage of the cathode of the nearest LED 13 of the series connection of LEDs 13 is close to 0 V and hence lower than a voltage that is required by the LED 39 (LEDx). At this time, in the second circuit 30-2, since the switching element 15 (Tr2-1) is off, the voltage that is required by the LED 39 (LEDx) is produced and a current flows through the LED 39 (LEDx) via the diode 38-2 (D2). If the diodes 38-1 and 38-2 (D1 and D2) are absent, when the switching element 17-1 (Tr1-1) of the first circuit 30-1 or switching element 17-2 (Tr2-1) of the second circuit 30-2 is turned on, the anode voltage of the LED 39 (LEDx) would become close to 0 V and hence no current would flow through it. Therefore, in the third embodiment, the diodes D1 and D2 actually serve to prevent interference due to a voltage difference, and the current control on the series connections of LEDs 13 and the LED 39 (LEDx) is the same as in a circuit in which the switching elements 17-1 and 17-2 (Tr1-1 and Tr2-1) are controlled according to clock signals. Also in the power source circuit that is modified according to the third embodiment, equivalent elements may be used arbitrarily as long as the above described operation can be performed.

Figure 5:
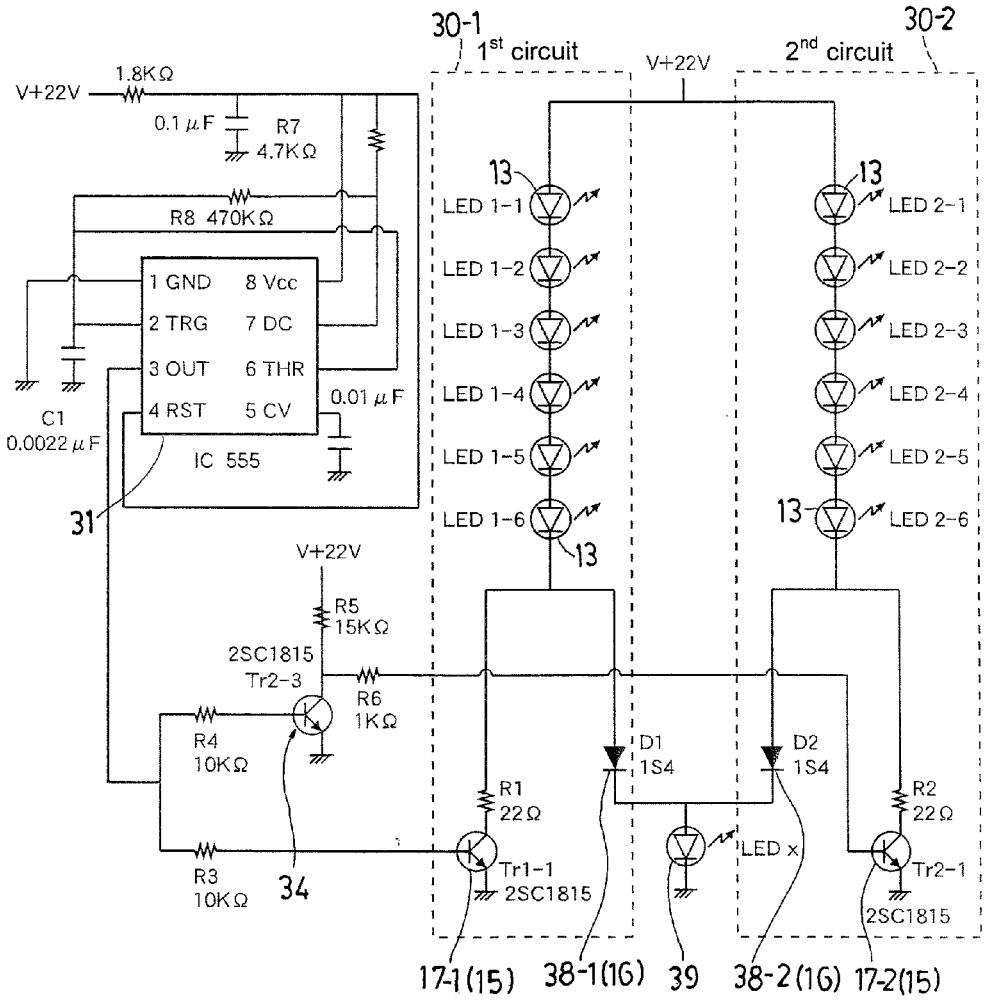
FIG. 5 is a circuit diagram of an LED driving power source device according to a fourth embodiment of the invention which is a specific version of the LED driving power source circuit according to the third embodiment.

FIG. 5 shows a LED driving power source device according to a fourth embodiment of the invention which is the same in basic configuration as and more specific than the LED driving power source device according to the third embodiment. Therefore, in the power source device according to the fourth embodiment, the signal current allocation number n is equal to 2 and the series connections of LEDs 13 of the first circuit 30-1 and the series connections of LEDs 13 of the second circuit 30-2 emit light alternately. The clock signal generation circuit 31 is centered by an integrated circuit IC (555), and the clock signal inversion circuit 34 is an npn transistor (2SC1815). The electronic switches 15 (Tr1-1 and Tr2-1) for causing flow of allowable forward currents having a duty ratio corresponding to the allocation number are also npn transistors (2SC1815). The diodes D1 and D2 for causing rated forward currents to flow through the LED 39 (LEDx) for preventing interference between the first circuit 30-1 and the second circuit 30-2 and producing for a forward voltage difference are diodes 1S4. The resistors R1 and R2 for fine adjustment of a forward voltage difference which are disposed upstream of the respective electronic switches 15 (Tr1-1 and Tr2-1) are resistors having a resistance 22 Ω. Resistors R3-R5 are provided to produce voltages and currents that are suitable for the control of the electronic switches 15 when a signal voltage (base voltage) that is output from the clock signal generation circuit 31 (IC1) is too high.

In the fourth embodiment, the clock period is determined by the combination of a resistor R7 (4.7 kΩ), a resistor R8 (470 kΩ), and a capacitor C1 (0.0022 μF) which are connected to the clock signal generation circuit 31 (IC1) (555). In this example, a signal of about 680 Hz is output from the No. 3 pin. The signal current is divided into two parts, and same pulse currents flow through the transistor electronic switch 17-1 (Tr1-1) and the transistor clock signal inversion circuit 34 (Tr2-3). Each of the electronic switches 17-1 (Tr1-1) and 34 (Tr2-3) is kept on while the pulse voltage is high and a current flows from the collector to the emitter. When the electronic switch 17-1 (Tr1-1) is on, power is supplied from the voltage source V+ (22 V) and a current flows through the series connection of LEDs 13 of the first circuit 30-1 and the LEDs 13 emit light. The current flows to the ground via the resistor R1 for fine adjustment and the electronic switch 17-1 (Tr1-1). Since the electronic switch 34 (Tr2-3) is also on, its collector potential is low and hence the electronic switch 17-2 (15, Tr2-1) is off because no base current flows through it. The electronic switch 34 (Tr2-3) serves as the signal inversion circuit, whereby power is supplied from the voltage source V+ (22 V) and a current flows through the series connection of LEDs 13 of the second circuit 30-2 and the LEDs 13 emit light. The current also flows through the LED 39 (LEDx) via the diode D2 and it emits light. The current finally flows to the ground.

As shown in FIG. 5, in this state, the first circuit 30-1 is regarded as a series connection of the series connection of six LEDs 13, the resistor R1 (22Ω), and the electronic switch Tr1-1. Since the voltage source V+ has a voltage 22 V, the forward voltage per LED 13 is calculated to be about 3.5 V (a voltage of about 0.9 V across the resistor R1 and a voltage of about 0.1 V across the electronic switch Tr1-1 are subtracted). Therefore, from FIG. 9, a corresponding current value is determined to be about 40 mA. Likewise, the second circuit 30-2 is regarded as a series connection of the series connection of six LEDs 13, the diode 38-2 (D2), and the LED 39 (LEDx). Since the voltage source V+ has the voltage 22 V, the forward voltage per LED 13 or 39 (LEDx) is calculated to be about 3.1 V (a voltage of about 0.3 V across the diode 38 (D2) is subtracted). Therefore, from FIG. 9, a corresponding current value is determined to be about 20 mA.

While no signal current exists (i.e., the pulse voltage is low), each of the electronic switches 17-1 (Tr1-1) and 34 (Tr2-3) are off and no current is permitted to flow from the collector to the emitter. When the electronic switch 34 (Tr2-3) is turned off, its collector potential increases and a base current comes to flow through the electronic switch 17-2 (Tr2-1) to turn on it. Power is supplied from the voltage source V+ (22 V) and a current flows through the series connection of LEDs 13 of the second circuit 30-2 and the LEDs 13 emit light. The current flows to the ground via the resistor R2 for fine adjustment and the electronic switch 17-2 (Tr2-1). At this time, in the first circuit 30-1, power is supplied from the voltage source V+ (22 V) and a current flows through the series connection of LEDs 13 of the first circuit 30-1 and the LEDs 13 emit light. The current also flows through the LED 39 (LEDx) via the diode D1 and it emits light. The current finally flows to the ground. As such, the first circuit 30-1 and the second circuit 30-2 operate according to the opposite clock waveforms.

Figure 6:
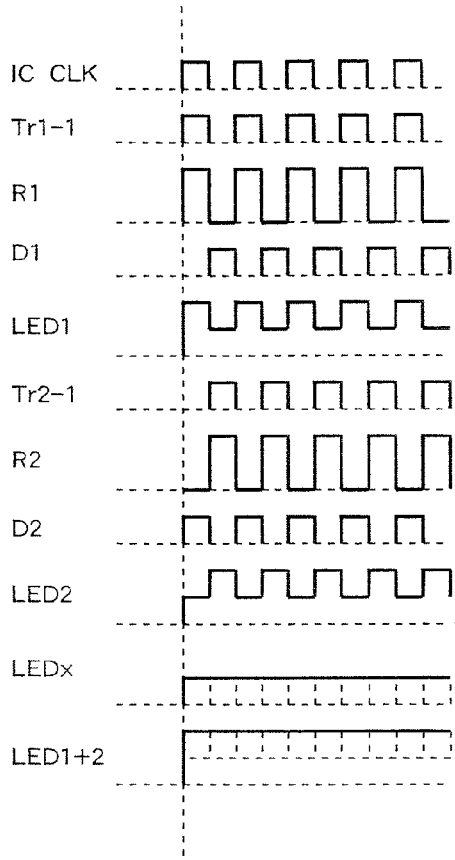
FIG. 6 is a timing chart showing how the LED driving power source device of FIG. 5 operates.

In the fourth embodiment, an allowable forward current of about 40 mA flows through the series connection of LEDs 13 of the first circuit 30-1 or the second circuit 30-2 for only half of the unit time and a rated current of about 20 mA flows through the series connection of LEDs 13 for the remaining half of the unit time. After a lapse of half of the unit time, this operation is performed with the first circuit 30-1 or the second circuit 30-2 interchanged. FIG. 6 is a timing chart showing an image of the above operation of the power source device according to the fourth embodiment.

The luminous intensity of each LED 13 used in the fourth embodiment is approximately doubled when the rated current is doubled. It is therefore understood that if the series connection of LEDs 13 of the first circuit 30-1 and that of the second circuit 30-2 in the power source device according to the fourth embodiment are each regarded as one light source, the luminous intensity is increased by about 50% (see FIGS. 7 and 8).

Figure 9:
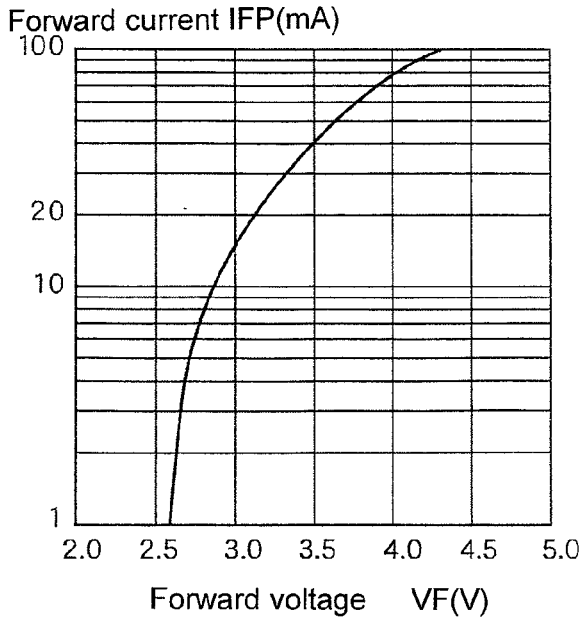
FIG. 9 is a graph showing a relationship between the forward current and the forward voltage of the LEDs used in the invention.
Figure 10:
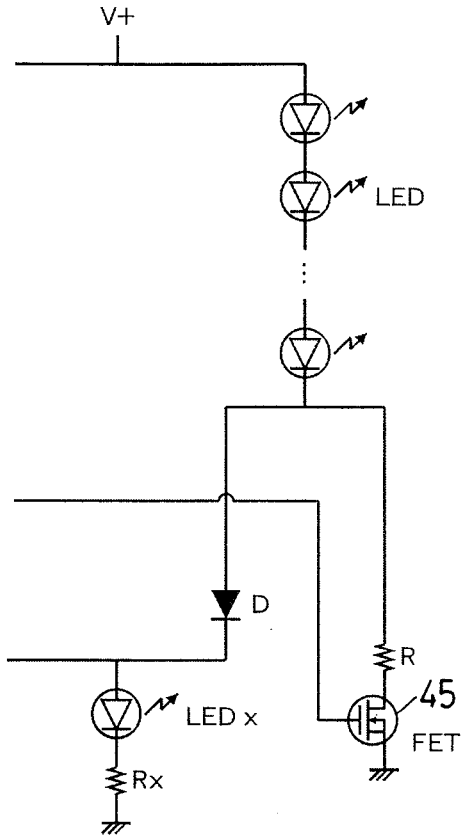
FIG. 10 is a circuit diagram of part of an LED driving power source device according to a fifth embodiment of the invention in which an electronic switch used in the fourth embodiment is replaced by an FET.

The current flowing through one series connection of LEDs 13 used in the fourth embodiment is calculated as follows (see FIG. 9). That is, the following is check formulae.

At the time of flow of a rated current:

0≅22 V (supplied from the voltage source)−0.3 V (diode voltage drop)−7×3.1 V (forward voltage when the current is about 20 mA)

At the time of flow of current increase:

0≅22 V (supplied from the voltage source)−0.1 V (transistor voltage drop)−6×3.5 V (forward voltage when the current is about 40 mA)−(about 40 mA)×22Ω (resistor voltage drop)

As for the statement made above to the effect that the clock signal of about 680 Hz is output from the No. 3 pin in the fourth embodiment shown in FIG. 5, this numerical value has no particular meaning. In the pulse current properties of existing LEDs, 1/10 of a unit time of 1 second is considered a time during which a maximum current can flow. Therefore, where the signal current allocation number n is equal to 10, the clock frequency should be higher than 10 Hz. Integrated circuits (74HC4017 and equivalents) used as the integrated circuit IC2 which serves as the clock signal allocation circuit 12 has, in many cases, a characteristic that only the first signal is output so as to have a two-cycle duration as Q1. To avoid destruction of the LEDs 13 in such a case, it is desirable that the clock frequency be higher than 20 Hz. Where an even higher clock frequency is used, it is desirable that the frequency be determined considering the balance between the heat generation and dissipation of the LEDs 13 used. That is, where the clock frequency is high, both of the large current flowing time and the heat generation time are short but the next cycle arrives before completion of heat dissipation, possibly resulting in destruction of LEDs 13 due to heat. In the second to fourth embodiments shown in FIGS. 3-5, since the large current flowing time is half of the unit time, the duty ratio is 50% and the clock frequency is at least 1 HZ. However, irrespective of the signal current allocation number n, a flicker phenomenon occurs if the clock frequency is too low. Therefore, the clock frequency should not be too high or too low.

Although the integrated circuit IC1 is used in the second to fourth embodiment, a flip-flop circuit or the like having about two transistors may be used instead so that its two seesaw-like outputs are used as a clock signal and an inverted clock signal.

Plural sets of a series connection of LEDs 13 may be connected in series or parallel arbitrarily and an FET 45 or the like may be used arbitrarily as a switching element in place of the transistor 15 (2SC1815) to increase the voltage/current resistance properties (see FIG. 10; fifth embodiment), in the fourth embodiment, for example. In this case, the FET can also be called an electronic switch.

Figure 11:
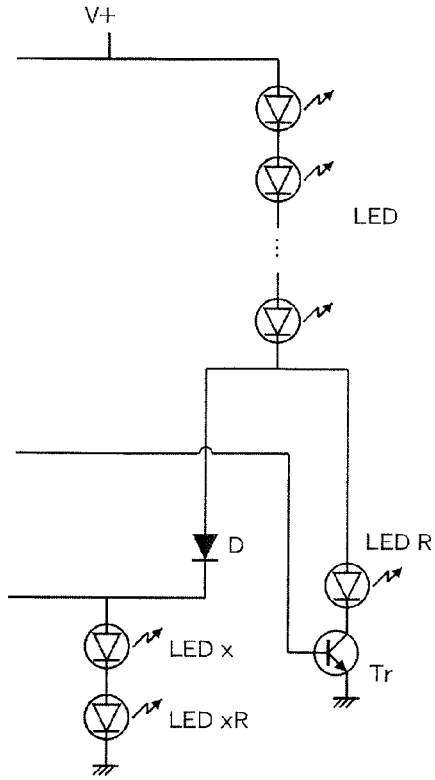
FIG. 11 is a circuit diagram of part of an LED driving power source device according to a sixth embodiment of the invention in which current limiting resistors used in the fourth embodiment are replaced by LEDs which are driven by a low voltage.

Depending on the use, the voltage difference, etc., the resistors R1, R2, Rn, and Rx may be replaced by red or yellow LEDs (LEDR, LEDnR, and LEDxR) that are driven by a low voltage of about 2 V (see FIG. 11; sixth embodiment). In this case, because of low-voltage use, yellow LEDs or the like may be used to provide, for example, light bulb color illumination by lowering the color temperature.

Figure 12:
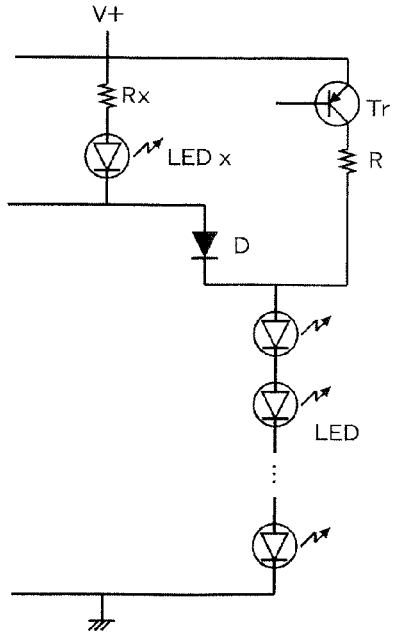
FIG. 12 is a circuit diagram of part of an LED driving power source device according to a seventh embodiment of the invention in which the fourth embodiment is modified so that control elements are provided on the power supply side.

The advantages of the invention can also be obtained by a connection method called "high side" in which the electronic switches and the LEDs LEDx are provided on the power supply side (see FIG. 12; seventh embodiment). Each of the techniques according to the fifth to seventh embodiments, which are minor circuit modifications, can be employed arbitrarily in the practice stage of the invention.

Figure 13:
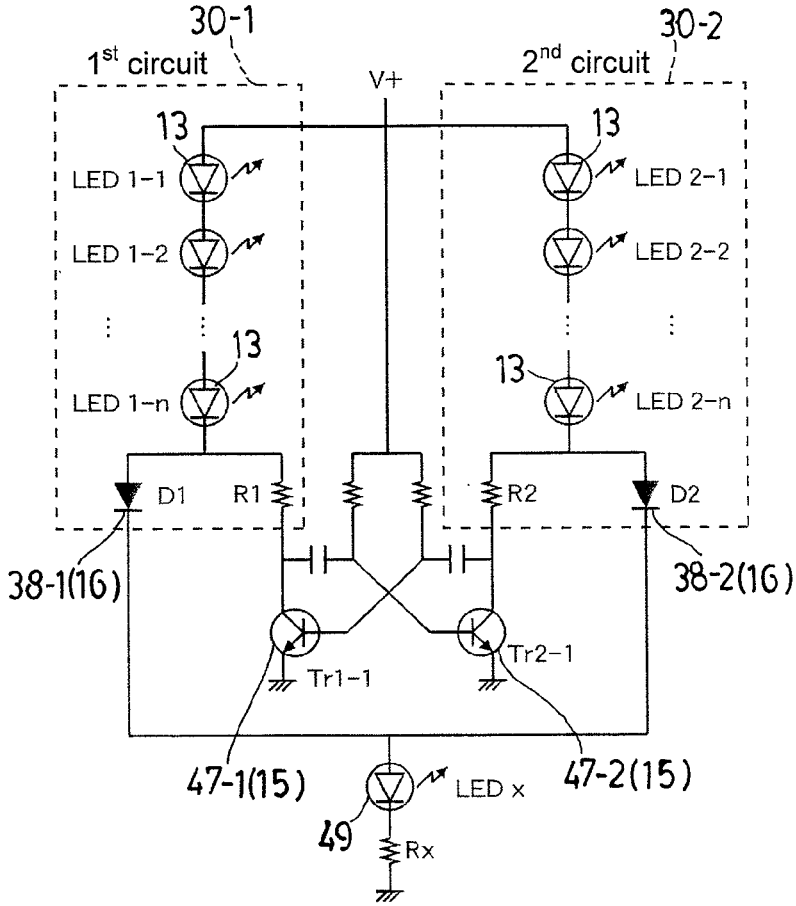
FIG. 13 is a circuit diagram of an LED driving power source device according to an eighth embodiment of the invention in which a pulse generating means is formed by electronic switches which oscillate spontaneously.

FIG. 13 shows a circuit according to an eighth embodiment which is based on the third embodiment and has a first circuit 30-1 and a second circuit 30-2. The signal generating means for controlling electronic switches 47-1 (15, Tr1-1) and 47-2 (15, Tr1-2) is a multivibrator (flip-flop) circuit that is formed by the electronic switches Tr1-1 and Tr1-2 which oscillate spontaneously. The first circuit 30-1 has a series connection of LEDs 13, a diode 38-1 (D1), a resistor R1 for fine adjustment, and the electronic switch Tr1-1. Likewise, the second 30-2 has a series connection of LEDs 13, a diode 38-2 (D2), a resistor R2 for fine adjustment, and the electronic switch Tr1-2. In the multivibrator circuit, the transistors 47-1 (15, Tr1-1) and 47-2 (15, Tr1-2) are turned on and off alternately as capacitors connected to their bases are charged and discharged. As in the third embodiment, the diodes 38-1 (D1) and 38-2 (D2) are switching elements for flow of rated forward currents.

Figure 14:
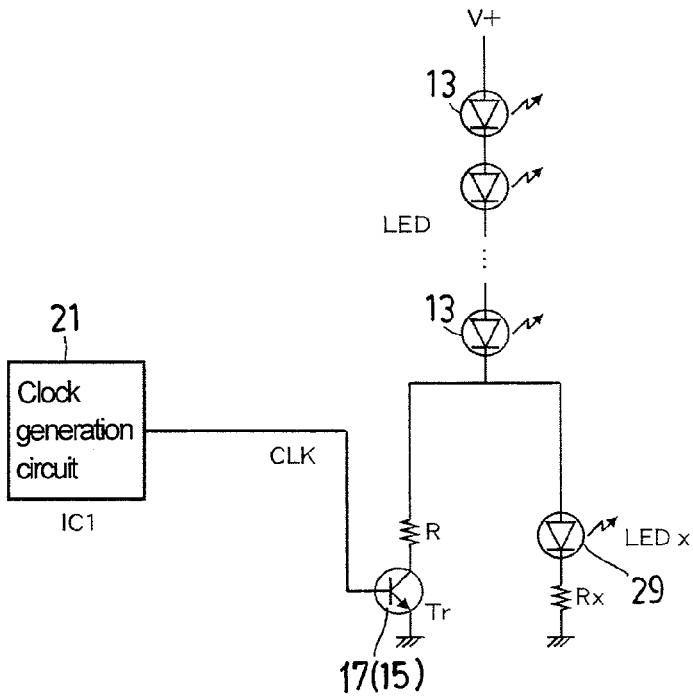
FIG. 14 is a circuit diagram of an LED driving power source device according to a ninth embodiment of the invention.
Figure 15:
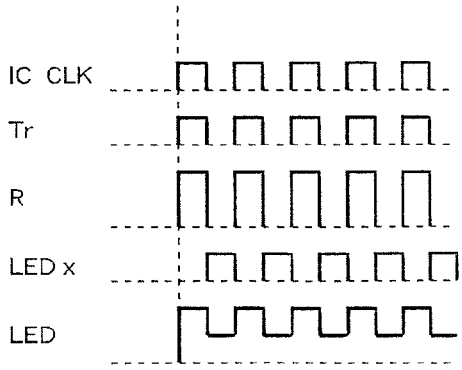
FIG. 15 is a timing chart showing how the LED driving power source device of FIG. 14 operates.

FIG. 14 shows a LED driving power source device according to a ninth embodiment in which the signal current allocation number n is equal to the minimum value 1. The power source device according to the ninth embodiment is equipped with a clock signal generation circuit 21, an electronic switch 15, and a series connection of LEDs 13 which is connected to the electronic switch 15. The power source device according to the second embodiment shown in FIG. 3 has the two blocks 20-1 and 20-2 each having the switching elements 15 and 16 and the series connection of LEDs 13 (n=2), and the degree of flickering is minimized by causing an allowable forward current and a rated forward current to flow through the series connection of LEDs 13 alternately. On the other hand, the power source device according to the ninth embodiment shown in FIG. 14 is equipped with only one block (n=1). Therefore, as seen from FIG. 15, the luminous intensity of the LEDs 13 varies during operation. However, if the clock signal frequency is sufficiently high (e.g., about 700 Hz), a flicker is not noticeable. As such, the power source device shown in FIG. 14 is a simplest implementation of the invention and is effective within the confines that a luminous intensity fluctuation is allowable.

The LED driving power source devices according to the first to ninth embodiments of the invention have been described above, which can also be expressed as an LED driving method which includes the steps of providing one or more blocks each of which includes an arbitrary number of series connections of LEDs; dividing a current signal for controlling operation of the LEDs in the blocks into plural signal currents; causing an allowable forward current having a duty cycle corresponding to a division number of the dividing step to flow through the LEDs in one of the blocks for an allowable time, using one of the plural signal currents; causing a rated forward current that does not cause destruction of LEDs to flow through the LEDs in the other blocks, using the other of the plural signal currents; driving the LEDs in the blocks by causing the allowable forward current and the rated forward current to flow periodically; and causing the rated forward current to flow through at least one additional LED and thereby producing a difference between respective voltages corresponding to the allowable forward current and the rated forward current.

That is, the driving method aspect of the invention includes the case that only one block having a series connection of LEDs is provided (n=1). This case corresponds to the ninth embodiment shown in FIG. 14. In this power source device, the flow of a signal current through the one block is turned on and off alternately, whereby a rated forward current and an allowable forward current having a duty ratio 50% to flow through the series connection of LEDs for an allowable time.

The case that two blocks each having a series connection of LEDs (n=2) corresponds to the second to eighth embodiments shown in FIGS. 3-13. In these power source devices, a signal current is caused to flow through the two blocks alternately, whereby a rated forward current and an allowable forward current having a duty ratio 50% to flow through each series connection of LEDs for an allowable time.

In the first embodiment, the clock generation circuit 11 generates a clock signal CLK1 and the clock signal allocation circuit 12 (signal current allocating means) divides the generated clock signal CLK1 into n parts (n: integer), whereby signals Q1, Q2, . . . , Qn each having a one-cycle pulse current are output successively. Thus, it can be said that this embodiment can be implemented with a highest degree of freedom.

In conventional illumination using LEDs, increasing the number of LEDs is a common method for luminous intensity enhancement. This necessarily results in a problem the number of LEDs cannot be increased because of space limitation due to miniaturization and other factors. In contrast, in illumination using LEDs, as described above the invention makes it possible to increase the luminous intensity with the same space by virtue of high power consumption efficiency. As such, the invention is very useful in practical use.

What is claimed is:

1. An LED driving method comprising:

providing one or more blocks each of which includes an arbitrary number of series connections of LEDs;

dividing a current signal for controlling operation of the LEDs in the blocks into plural signal currents;

causing an allowable forward current having a duty cycle corresponding to a division number of the dividing step to flow through the LEDs in one of the blocks for an allowable time, using one of the plural signal currents;

causing a rated forward current that does not cause destruction of LEDs to flow through the LEDs in the other blocks, using the other of the plural signal currents;

driving the LEDs in the blocks by causing the allowable forward current and the rated forward current to flow periodically; and causing the rated forward current to flow through at least one additional LED and producing a difference between respective voltages corresponding to the allowable forward current and the rated forward current.

2. An LED driving power source device comprising:

a pulse current generating means for generating pulse currents as a current signal for controlling operation of series connections of LEDs;

a signal current allocating means for generating signal currents by switching the current signal generated by the pulse current generating means in units of a period of the current signal;

first switching circuits each of which is turned on only during periods when a signal current produced by the signal current allocating means flows and causes an allowable forward current having a duty cycle corresponding to an allocation number of the signal current allocating means to flow through one of the series connections of LEDs;

second switching circuits each of which is turned on only during periods when no signal current produced by the signal current allocating means flows and causes a rated forward current that does not cause destruction of LEDs to flow through the other of the series connections of LEDs; and at least one additional LED for producing a difference between respective voltages corresponding to the allowable forward current and the rated forward current as a result of flow of the rated forward current through the additional LED, the series connections of LEDs being driven by causing the allowable forward current and the rated forward current to flow periodically for an allowable time determined by the switching of the signal current allocating means.

3. The LED driving power source device according to claim 2, wherein the pulse current generating means is a clock generation circuit for generating the current signal, and the signal current allocating means comprises an allocation circuit for generating signals including the respective signal currents and an inversion circuit for inverting the signals generated by the allocation circuit.

4. The LED driving power source device according to claim 2, wherein the pulse current generating means comprises an AC power source and signal generating means for generating a signal current by detecting cycles of an output voltage of the AC power source.

5. The LED driving power source device according to claim 2, wherein the signal current allocating means switches the current signal in such a manner that a switching element oscillates spontaneously.

* * * * *